US007343110B2

(12) United States Patent
Sakamoto

(10) Patent No.: US 7,343,110 B2
(45) Date of Patent: Mar. 11, 2008

(54) COLOR IMAGE FORMING DEVICE HAVING A TEMPERATURE DETECTOR

(75) Inventor: Junshin Sakamoto, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 204 days.

(21) Appl. No.: 11/195,819

(22) Filed: Aug. 3, 2005

(65) Prior Publication Data

US 2006/0029407 A1 Feb. 9, 2006

(30) Foreign Application Priority Data

Aug. 4, 2004 (JP) ..... 2004-227476

(51) Int. Cl.
*G03G 15/00* (2006.01)
*G03G 15/01* (2006.01)

(52) U.S. Cl. ..... 399/44; 399/301

(58) Field of Classification Search ..... 399/44, 399/94, 301, 299, 49
See application file for complete search history.

(56) References Cited

U.S. PATENT DOCUMENTS 6,418,295 B1 * 7/2002 Sato ..... 399/301
7,133,056 B2 * 11/2006 Tanaka et al. ..... 347/116

FOREIGN PATENT DOCUMENTS

JP 3-293679 12/1991
JP 2000-231233 8/2000
JP 2003-207976 7/2003

* cited by examiner

*Primary Examiner*—Hoang Ngo
(74) *Attorney, Agent, or Firm*—Oblon, Spivak, McClelland, Maier & Neustadt, P.C.

(57) ABSTRACT

A color image forming device can minimize a registration error in a color image. A plurality of image forming units form the color image on a recording material. An image position detector detects a position of each patch pattern of a toner image formed on the recording material. A temperature detector detects a temperature inside the color image forming device. A registration error correction control part performs a first correcting operation and a second correcting operation, the first correcting operation for correcting a registration error of image in accordance with the position detection signal of the image position detector, the second correcting operation for correcting a registration error predicted by referring to a correction table, which includes a correction value previously determined in response to the temperature inside the color image forming device and an offset value, which is changed each time the first correcting operation is performed. The second correcting operation corrects the registration error by a value corresponding to the correction value plus or minus the offset value.

11 Claims, 11 Drawing Sheets

FIG.2

| ABSOLUTE TEMPERATURE T(℃) | PREDICTIVE REGISTRATION ERROR CORRECTION VALUE ΔE(μm) |
|---|---|
| T−3 | ΔE−3 |
| T−2 | ΔE−2 |
| T−1 | ΔE−1 |
| T0 | ΔE0 |
| T1 | ΔE1 |
| T2 | ΔE2 |
| T3 | ΔE3 |
| T4 | ΔE4 |
| T5 | ΔE5 |
| T6 | ΔE6 |
| T7 | ΔE7 |
| T8 | ΔE8 |

FIG.9

| ABSOLUTE TEMPERATURE T (°C) | PREDICTIVE REGISTRATION ERROR CORRECTION VALUE ΔE (μm) | OFFSET VALUE OFFSET (μm) | | |
|---|---|---|---|---|
| | | STEP 1 | STEP 2 | STEP 3 |
| T-3 | ΔE-3 | 0 | 0 | 0 |
| T-2 | ΔE-2 | 0 | 0 | 0 |
| T-1 | ΔE-1 | 0 | 0 | 0 |
| T0 | ΔE0 | 0 | 0 | 0 |
| T1 | ΔE1 | 0 | Y | 0 |
| T2 | ΔE2 | 0 | Y | KY |
| T3 | ΔE3 | 0 | Y | 0 |
| T4 | ΔE4 | 0 | Y | KY |
| T5 | ΔE5 | 0 | Y | 0 |
| T6 | ΔE6 | 0 | Y | KY |
| T7 | ΔE7 | 0 | Y | 0 |
| T8 | ΔE8 | 0 | Y | KY |

FIG.11

| ABSOLUTE TEMPERATURE T (°C) | PREDICTIVE REGISTRATION ERROR CORRECTION VALUE ΔE (μm) | | | OFFSET VALUE OFFSET (μm) | | |
|---|---|---|---|---|---|---|
| | TEMPERATURE DIFFERENCE TO REFERENCE COLOR 0°C | TEMPERATURE DIFFERENCE TO REFERENCE COLOR 1°C | TEMPERATURE DIFFERENCE TO REFERENCE COLOR 2°C | STEP 1 | STEP 2 | STEP 3 |
| T−3 | (ΔE·3)0 | (ΔE·3)1 | (ΔE·3)2 | 0 | 0 | 0 |
| T−2 | (ΔE·2)0 | (ΔE·2)1 | (ΔE·2)2 | 0 | 0 | 0 |
| T−1 | (ΔE·1)0 | (ΔE·1)1 | (ΔE·1)2 | 0 | 0 | 0 |
| T0 | (ΔE0)0 | (ΔE0)1 | (ΔE0)2 | 0 | 0 | 0 |
| T1 | (ΔE1)0 | (ΔE1)1 | (ΔE1)2 | 0 | Y | 0 |
| T2 | (ΔE2)0 | (ΔE2)1 | (ΔE2)2 | 0 | Y | KY |
| T3 | (ΔE3)0 | (ΔE3)1 | (ΔE3)2 | 0 | Y | 0 |
| T4 | (ΔE4)0 | (ΔE4)1 | (ΔE4)2 | 0 | Y | KY |
| T5 | (ΔE5)0 | (ΔE5)1 | (ΔE5)2 | 0 | Y | 0 |
| T6 | (ΔE6)0 | (ΔE6)1 | (ΔE6)2 | 0 | Y | KY |
| T7 | (ΔE7)0 | (ΔE7)1 | (ΔE7)2 | 0 | Y | 0 |
| T8 | (ΔE8)0 | (ΔE8)1 | (ΔE8)2 | 0 | Y | KY |

COLOR IMAGE FORMING DEVICE HAVING A TEMPERATURE DETECTOR

BACKGROUND OF THE INVENTION

1. Field of the Invention

The present invention generally relates to color image forming devices that print an image according to image data and, more particularly, to a color image forming device that can correct a registration error of an image with high accuracy at reduced toner consumption.

2. Description of the Related Art

There is known a tandem-type color image forming device, which comprises a plurality of image forming units arranged around the photosensitive member in a direction of travel of a recording medium. Each of the image forming units includes a photosensitive member and charging means, exposing means and developing means arranged around the photosensitive member. In the color image forming device, toner images of different colors are formed on the photosensitive members and the color images are sequentially transferred onto a recording medium and the color toner images are fixed on the recording medium.

The tandem-type color image forming device can easily achieve a high-speed operation since the image forming unit is provided for each color. However, there is a problem that an image quality is deteriorated since it is difficult to form each color image on the recording medium without registration error between the color toner images. One of causes of such a registration error is a positional shift of the color toner image due to a relative registration error generated between the image forming units caused by a change with time or a change in temperature.

Moreover, there also is a registration error generated between the color toner images due a small error or fluctuation in a velocity of photosensitive member and an intermediate transfer member. In order to prevent the image quality from being deteriorated due to such a registration error, there is known a method of correcting a registration error by forming color toner images, that is, patch patterns, on the recording medium or the intermediate transfer member so as to correct the registration error by detecting the patch patterns by a photo-detector.

In order to suppress the above-mentioned registration error as small as possible, it is required to raise the detection accuracy of the registration error. Usually, it is preferable to set the registration error between the color images to 100 μm or less at maximum and 50 μm or less on the average. In order to do so, it is desired that the image position detector can detect a registration error with an accuracy of 10 μm or less.

A registration error of each color toner image relative to a reference color toner image is calculated using a detection signal acquired from the image position detector so as to perform a correction control of a registration error by adjusting a write timing of an optical unit in each image forming unit other than that of the reference color or perform a correction control for correcting a position of the optical units.

However, each time when a relative registration error is generated between the image forming units due to a temperature rise in the device after registration error correction is made by an image position detector, the patch patterns must be formed so as to detect and calculate an amount of registration error by the image position detector. Accordingly, there is a problem in that a throughput of printing is deteriorated and an amount of toner consumption is increased, which increases a page cost. Thus, there is suggested a correction control by predicting an amount of registration error by detecting a temperature.

The technique to carry out such a predictive control of a registration error in response to a temperature is disclosed in the following patent documents 1 and 2.

Patent Document 1: Japanese Laid-Open Patent Application No. 3-293679

Patent Document 2: Japanese Laid-Open Patent Application No. 2003-207976

A description will now be given, with reference to FIG. 1 through FIG. 3 of an example of a conventional predictive control of a registration error. FIG. 1 shows a process flow of a conventional predictive control method. First, in step 101, patch patterns are formed on a recording medium, and a correction of a registration error is carried out by detecting the patch patterns. Then, in step 102, a temperature inside the image forming device is detected, and the detected temperature is stored in a memory of a control device as a reference temperature. In this example, the reference temperature is set as T0.

In step 103, it is determined whether or not the temperature inside the device reaches a temperature of predictive registration error correction timing. Here, as shown in FIG. 3, a time when an absolute temperature inside the device reaches T1, T2 or T3 is determined as correction timing. It should be noted that the above-mentioned absolute temperature does not mean a physical absolute temperature, but means a temperature absolute to a relative temperature. Of course, the predictive correction is not necessarily performed when the temperature (absolute temperature) inside the device reaches T1, T2 or T3, but may be performed when a temperature difference (relative temperature) between the temperature inside the device and T0 reaches a predetermined value.

In this example, in order to perform the predictive registration error correcting operation, a correction table as shown in FIG. 2 is stored in a memory of the control device. The correction table indicates that a predictive registration error correction value is ΔE0, ΔE1, ΔE2, . . . when the temperature inside the device is an absolute temperature of T0, T1, T2, . . .

Then, if a result of the determination in step 103 is affirmative (YES), that is, for example, the reference temperature is T0 and if the temperature reaches T1 by a temperature rise after that, the routine proceeds to step 104 so as to perform an operation to correct the amount of registration error ΔE1 corresponding to the temperature T1. Similarly, if the temperature of the device reaches T2 or T3, the predictive registration error correction value ΔE2 and ΔE3 are read by referring to the table shown in FIG. 2 so as to perform a registration error correcting operation in accordance with the predictive registration error correction values.

Further, in step 105, it is determined whether or not an image registration error detection correcting operation timing is reached. That is, the timing is determined according to not the prediction but a result of detection of an actually generated registration error by actually forming patch patterns on the recording medium. The image registration error detection operation timing may be a time when a predetermined time period has passed or a time when the temperature inside the device exceeds a temperature risen from the reference temperature by a predetermined value. If a result of the determination in step 105 is affirmative (YES), the routine returns to step 101 so that the same operation is repeated.

However, if a registration error other than that defined in the table is generated, for example, if a change in an amount of registration error due to individual variation or a change in an amount of registration error due to long time of use is generated, there is a problem in the above-mentioned color image forming device that there is no means for automatically correcting the registration error, which results in an increase in an error of the predictive registration error correction according to a temperature and invites deterioration in the image quality, since the above-mentioned conventional example predicts an amount of registration error according to a relationship (table) between to a previously set temperature and an amount of correction so as to perform a correction.

On the other hand, in a case where the image forming units are arranged in a vertical direction, the image forming unit in the upper stage is given an influence of heat generated by the image forming unit of the lower stage, and there is a case where a temperature change rate per unit time of the image forming unit of the upper stage may be different from that of the image forming unit of the lower stage. Thus, there is a case where a single predictive registration error correction table cannot cover all cases.

SUMMARY OF THE INVENTION

It is a general object of the present invention to provide an improved and useful color image forming device in which the above-mentioned problems are eliminated.

A more specific object of the present invention is to provide a color image forming device having registration error correcting means which can minimize a registration error in a control to correct the registration error by predicting the registration error by detecting a temperature in a case where a predicted correction value is changed due to individual variation or a change with time passage or in a case where a temperature difference is generated between image forming units.

In order to achieve the above-mentioned objects, there is provided according to one aspect of the present invention a color image forming device comprising: a plurality of image forming units that form a color image on a recording material; an image position detector that detects a position of each patch pattern of a toner image formed on the recording material and outputs a position detection signal corresponding to the detected position; a temperature detector that detects a temperature inside the color image forming device and outputs a temperature detection signal corresponding to the detected temperature; and a registration error correction control part that performs a first correcting operation and a second correcting operation, the first correcting operation for correcting a registration error of image in accordance with the position detection signal of the image position detector, the second correcting operation for correcting a registration error predicted by referring to a correction table previously prepared in accordance with the temperature detection signal of the temperature detector, wherein the correction table includes a correction value previously determined in response to the temperature inside the color image forming device and an offset value, which is changed each time the first correcting operation is performed; and the second correcting operation corrects the registration error by a value corresponding to the correction value plus or minus the offset value.

In the color image forming device according to the above-mentioned invention, the registration error correction control part may perform the second correcting operation N times between one execution of the first correcting operation and a subsequent execution of the first correcting operation. The correction table may include a column indicative of a first offset value and a column indicative of a second offset value so as to set the first offset value when X/N is greater than a minimum correction pitch P and set the second offset value when X/N is smaller than the minimum correction pitch, where X is a registration error correction amount in the first correcting operation. Y may be set as the first offset value when Y>P, where Y is an absolute value of X/N. When Y<P, KY is set as the second offset value for each K times in N times of the second correcting operations, where Y is an absolute value of X/N and K is an integer value of P/Y.

In the color image forming device according to the above-mentioned invention, the temperature detector may include a plurality of detectors that detect temperatures inside the color image forming device so as to determine the temperature inside the color image forming device as an average value of detection signals of the detectors.

In the color image forming device according to the above-mentioned invention, the temperature detector may include a plurality of detectors that detects temperatures inside the color image forming device so as to detect a temperature difference between a temperature of an image forming unit of a reference color and a temperature of an image forming unit of a color other than the reference color. The correction table may contain a first correction value corresponding to a temperature of the image forming unit of the reference color and a second correction value previously determined in accordance with the temperature difference. When performing the second correcting operation, the first correction value is used for the image forming unit of the reference color and the second correction value is used for the image forming unit of the color other than the reference color.

In the above-mentioned color image forming device according to the present invention, when performing the second correcting operation, the image forming unit of the reference color and the image forming unit of the color other than the reference color may use different correction values.

There is provided according to another aspect of the present invention a color image forming device comprising: a plurality of image forming units that form a color image on a recording material; an image position detection device that detects a position of each patch pattern of a toner image formed on the recording material; a correction control device that corrects a registration error in the color image in accordance with a registration error of the patch pattern; and a temperature detector that detects a temperature of at least one of the image forming units, wherein the correction control device has a correction table having a relationship between the temperature detected by the temperature detector and a registration error correction value corresponding to the temperature and detects a registration error of the patch pattern so as to perform image registration error correction and performs a predictive registration error correction using the correction table, and wherein the registration error correction is performed in accordance with the image position detection after execution of the prediction registration error correction N (N>1) times so as to correct the registration error correction value or an offset value thereof in the correction table in accordance with the registration error correction value by the image position detection.

Additionally, there is provided according to another aspect of the present invention a color image forming device comprising: a plurality of image forming units arranged in a vertical direction along a recording material so as to form a color image on the recording material; an image position detection device that detects a position of each color patch pattern of a toner image formed on the recording material; a correction control device that corrects a registration error in the color image in accordance with a registration error of the patch pattern; and a temperature detector that detects a temperature of at least two of the image forming units, wherein the correction control device has a correction table having a relationship between the temperature detected by the temperature detector and a registration error correction value corresponding to the temperature so as to perform a predictive registration error correction using the correction table, and wherein a temperature difference between the image forming unit of a reference color and the image forming unit of a color other than the reference color is detected or calculated by the temperature detector so as to perform the predictive registration error correction in accordance with the registration error correction value different for each image forming unit.

According to the present invention, the predictive registration error correction can be performed more accurately, thereby providing the color image forming device that can correct image registration error with high accuracy at reduced toner consumption.

Other objects, features and advantages of the present invention will become more apparent from the following detailed description when read in conjunction with the accompanying drawings.

BRIEF DESCRIPTION OF THE DRAWINGS

FIG. 2 is an illustration showing a correction table used in the conventional device:

FIG. 9 is an illustration showing a correction table indicating a relationship between a temperature, a predicted registration error correction value and an offset value;

FIG. 11 is an illustration showing a table indicating a relationship between a reference color temperature, a predicted registration error correction value for a temperature difference with respect to a reference color, and an offset value;

DETAILED DESCRIPTION OF THE PREFERRED EMBODIMENTS

A description will now be given, with reference to FIGS. 4 through 13, of embodiments according to the present invention.

Figure 4:
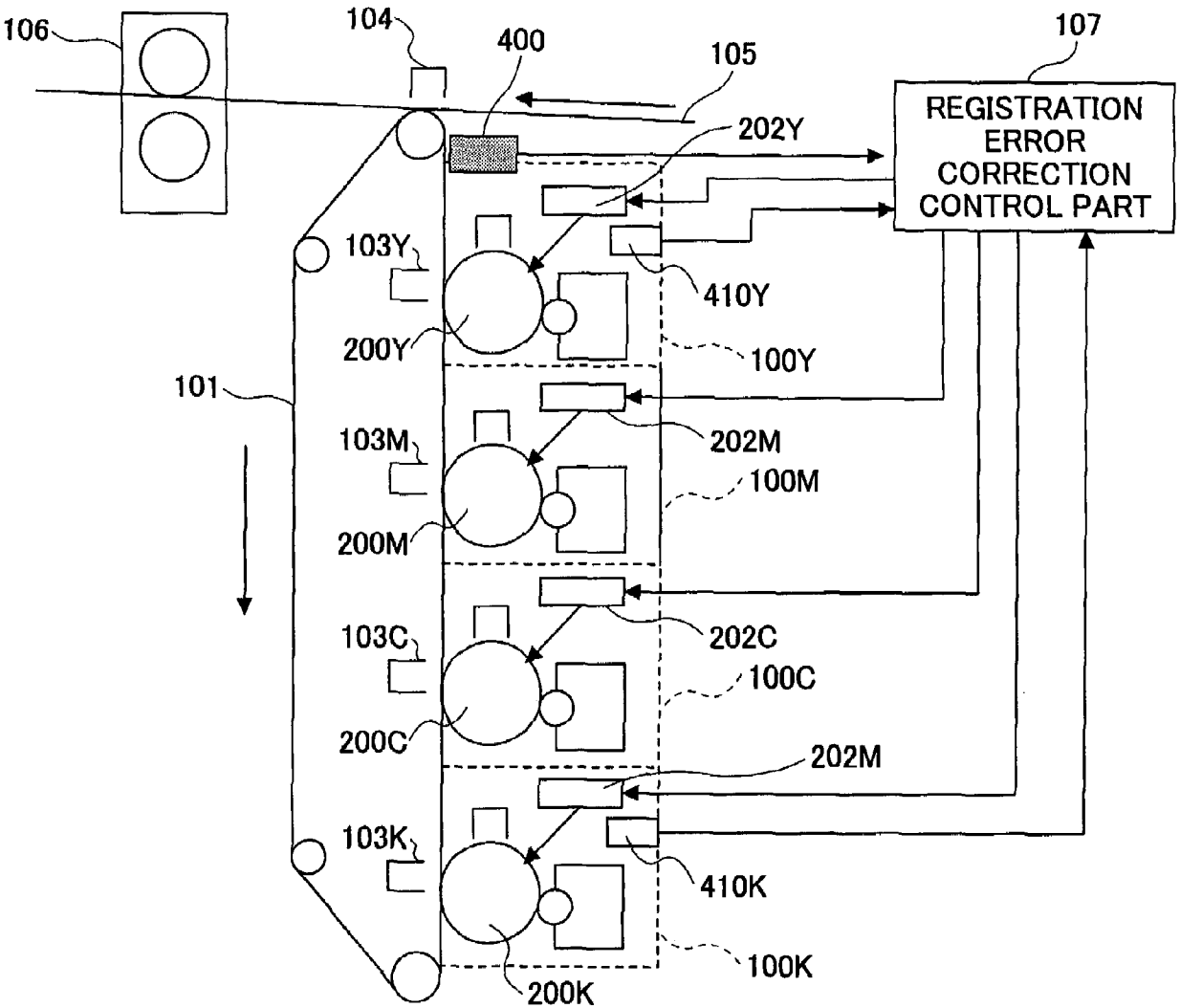
FIG. 4 is an illustration showing an outline structure of a color image forming device according to the present invention.
Figure 5:
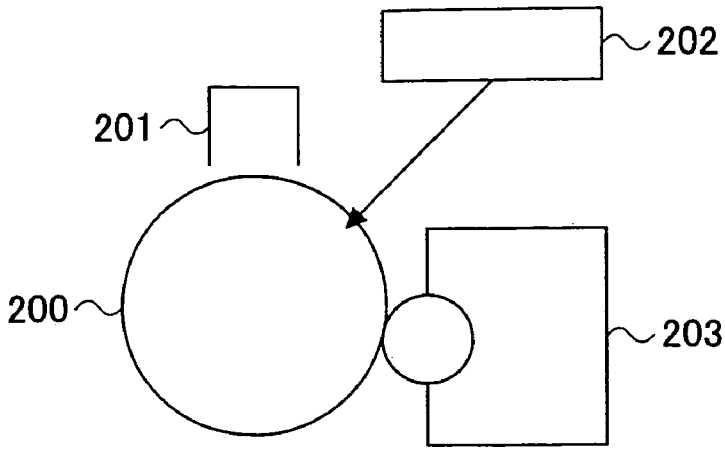
FIG. 5 is an illustration of a color forming unit.

FIG. 4 shows a structure of a color image forming device according to the present invention using Y (yellow), M (magenta), C (cyan) and K (black). The color image forming device shown in FIG. 4 comprises an intermediate transfer member 101 and a Y-unit 110Y, a M-unit 100M, a C-unit 100C and a K-unit 100K that are arranged in the vicinity of the intermediate transfer member 101 in a vertical direction. Each of the Y-unit 110Y, the M-unit 100M, the C-unit 100C and the K-unit 100K comprises, as shown in FIG. 5, a photosensitive member 200, a charger unit (charging means) 201, an exposure unit (exposing means) 202 and a developer unit (developing means) 203 so as to form a color toner image on the photosensitive member 200 through a series of electronic photograph processes. The Y-unit 110Y, the M-unit 100M, the C-unit 100C and the K-unit 100K as a whole may be referred to as color units or simply units.

The color toner images formed by the color units 100Y, 100M, 100C and 100K are sequentially transferred onto the intermediate transfer member 101 by a Y first transfer unit (Y first transfer means) 103Y, an M first transfer unit (M first transfer means) 103M, a C first transfer unit (C first transfer means) 103C and a K first transfer unit (K first transfer means) 103K, respectively. The color toner images transferred onto the intermediate transfer member 101 are transferred onto a recording paper 105 by a second transfer unit (second transfer means) 104, and are fixed on the recording paper 105 by a fixing unit (fixing means) 106.

The color image forming device according to the present invention is provided with a registration error correction control part 107. A detection signal of an image position detector 400 mentioned later and detection signals of temperature detectors 410Y and 410K are supplied to the control part 107. Additionally, an exposure timing signal is supplied from the above-mentioned control part 107 to each of the exposure units 202Y, 202M, 202C and 202K of the units 100Y, 100M, 100C and 100K.

Figure 6:
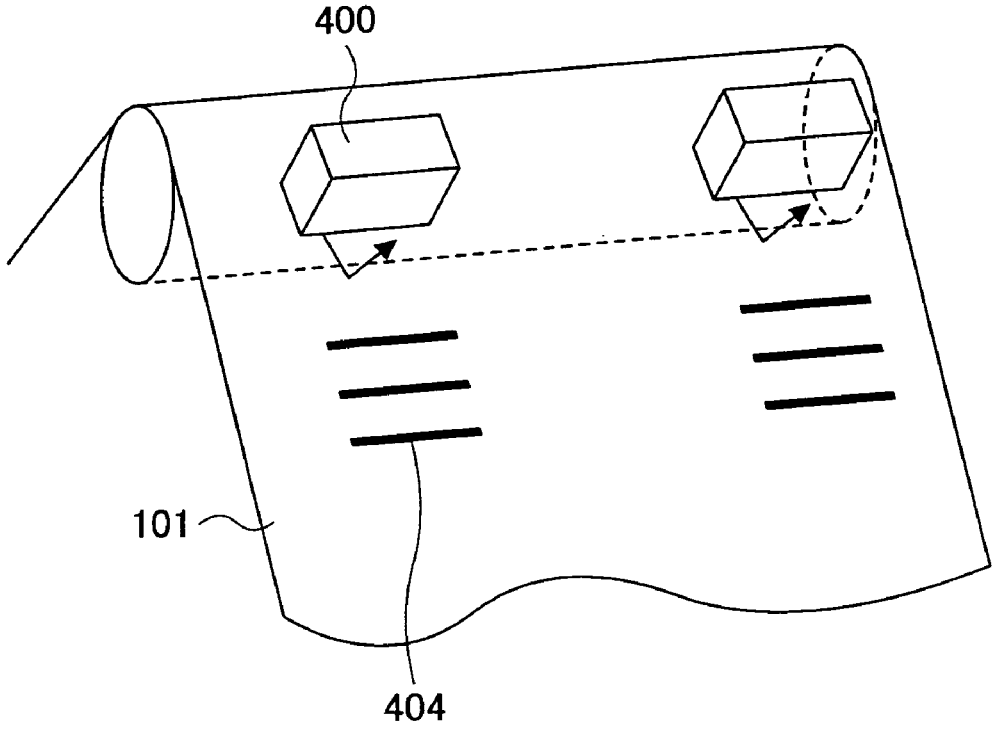
FIG. 6 is an illustration showing a positional relationship between a recording medium and an image position detection device.

The above-mentioned color image forming device performs an operation to correct a registration error between color toner images when a power is turned on or when a temperature inside the device changed more than a predetermined range. That is, as shown in FIG. 6, registration error detection toner image patterns 404 formed by each unit are transferred onto the intermediate transfer member 101, and conveyed by the intermediate transfer member 101. The toner image patterns 404 are detected by the image position detectors 400. A time interval between a detection signal of a specific color toner image pattern, that is, a black toner image pattern in this example, and each of detection signals of Y, M and C toner image patterns is measured. A control to suppress a relative registration error between color image patterns is performed by controlling light-emitting timing of a laser beam emitted by the exposure unit of each unit in accordance with the measured time interval which is a relative time difference.

Figure 7:
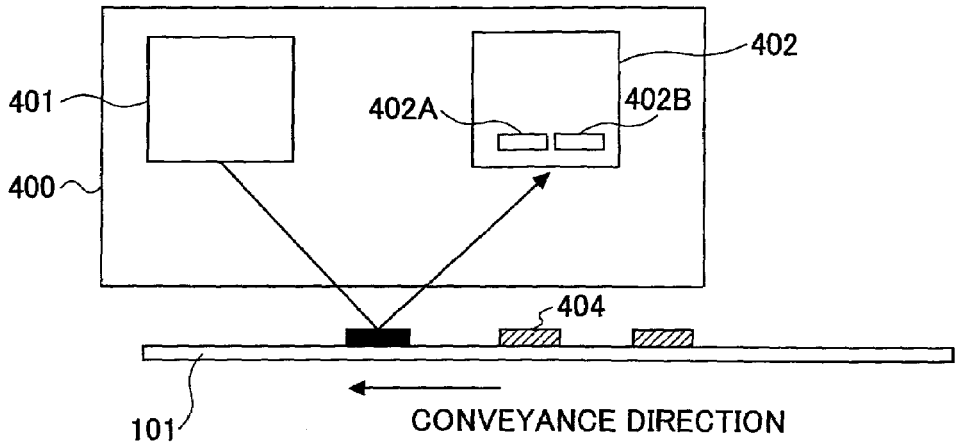
FIG. 7 is an illustration of an outline structure the image position detection device.

FIG. 7 shows an outline structure of the image position detector 400. A light emitted by a light-emitting part 401 is irradiated onto the intermediate transfer member 101. The light reflected by the intermediate transfer member 101 is irradiated onto a light receiving part 402. A light reflected by the toner image 404 formed on the intermediate transfer member 101 is received by the light-receiving part 402, and a detection signal is generated in accordance with an amount of the reflected light.

The light-receiving part 402 is provided with two detectors 402A and 402B. When the patch pattern 404 formed on the intermediate transfer member 101 passes by the image position detector 400, the reflected light incident on the detectors 402A and 402B fluctuates. The fluctuation of the reflected light is detected first by the detector 402, and thereafter detected by the detector 402B. Thus, there is a slight time difference between the detection signals of the detectors 402A and 402B. By detecting a timing in the middle of the two signals, external disturbance or influences due to an environment is suppressed as small as possible. Such a detection method of the patch pattern is known to the public, and is disclosed, for example, in Japanese Laid-Open Patent Application No. 2000-231233.

The above-mentioned operation is performed when the device is started up, a specific condition is established, for example, a predetermined temperature rise value is reached, or a predetermined number of sheets is reached in pressrun. During the operation of the image position correction, the printing operation on the recording medium is not performed so as to form the patch patterns on the intermediate transfer belt. Accordingly, if the image position correction is performed frequently, a throughput of the printing is down. Therefore, it must be avoided to increase the frequency of the correcting operation. Thus, in the color image forming device according to the present invention, the number of image position detection correcting operations during the printing operation is reduced as much as possible by predicting a relative registration error between the color images by using one of or both the detection signals of the temperature detectors 410K and 410Y. It should be noted that although the temperature detectors are provided in the uppermost Y-unit 100Y and the lowermost K-unit 100K in the present embodiment, the present invention is not limited to such an arrangement. For example, it is possible to perform prediction using a representative value or average value of the detection signals or a temperature difference between the color units by providing the temperature detector to each color unit.

A description will now be given of the predictive registration error correcting operation using the temperature detector.

Figure 8:
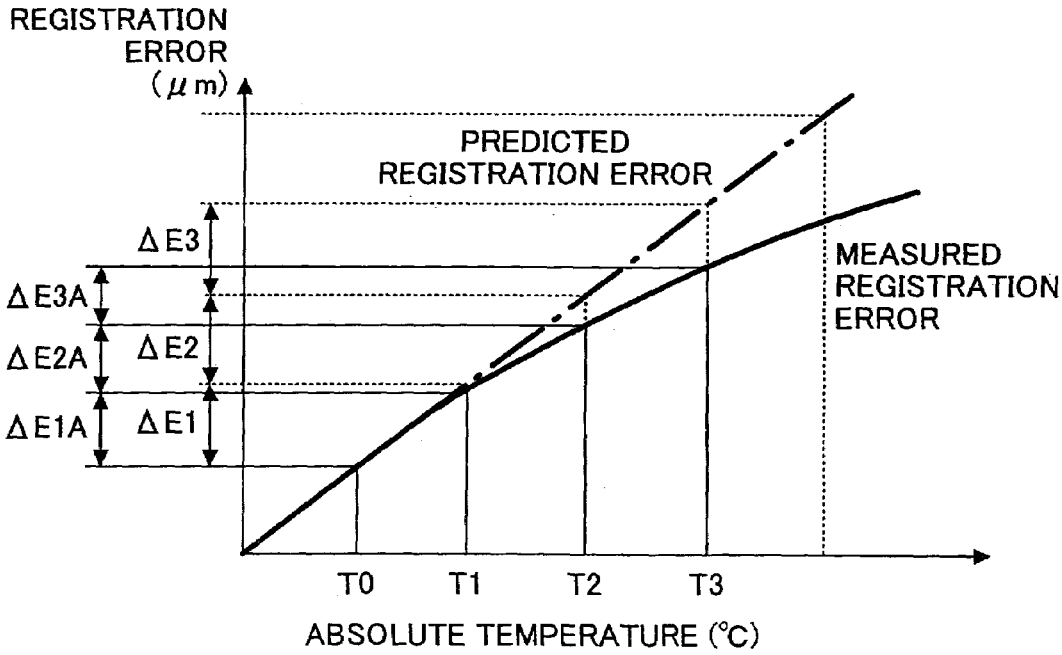
FIG. 8 is a graph showing a relationship between a registration error and an absolute temperature.

FIG. 8 is a graph showing a relationship between a detected temperature inside the image forming device and a color registration error amount between the color images, the horizontal axis representing the detected temperature in an absolute temperature and the vertical axis representing the registration error.

Conventionally, it is considered that an amount of registration error when the temperature T0, which is an initial temperature inside the device, changes to T1 is ΔE1 and when the temperature changes from T1 to T2 and from T2 to T3, the predicted registration error changes to ΔE2 and ΔE3, respectively. However, as shown in FIG. 8, the predicted color registration error actually changes as indicated by a solid line curve due to individual variation or a change with time passage. That is, the actual color registration error amount is ΔE1A, ΔE2A and ΔE3A, and a difference between the predicted registration error and the actual registration error is increased as the absolute temperature inside the device increases from T1 to T3.

Therefore, despite the actual color registration error amounts are ΔE1A, ΔE2A and ΔE3A, the registration error amount is gradually increased if the predictive registration error correction is performed with the prediction registration error correction is performed with the predicted value being set to ΔE1A, ΔE2A and ΔE3A.

Figure 10:
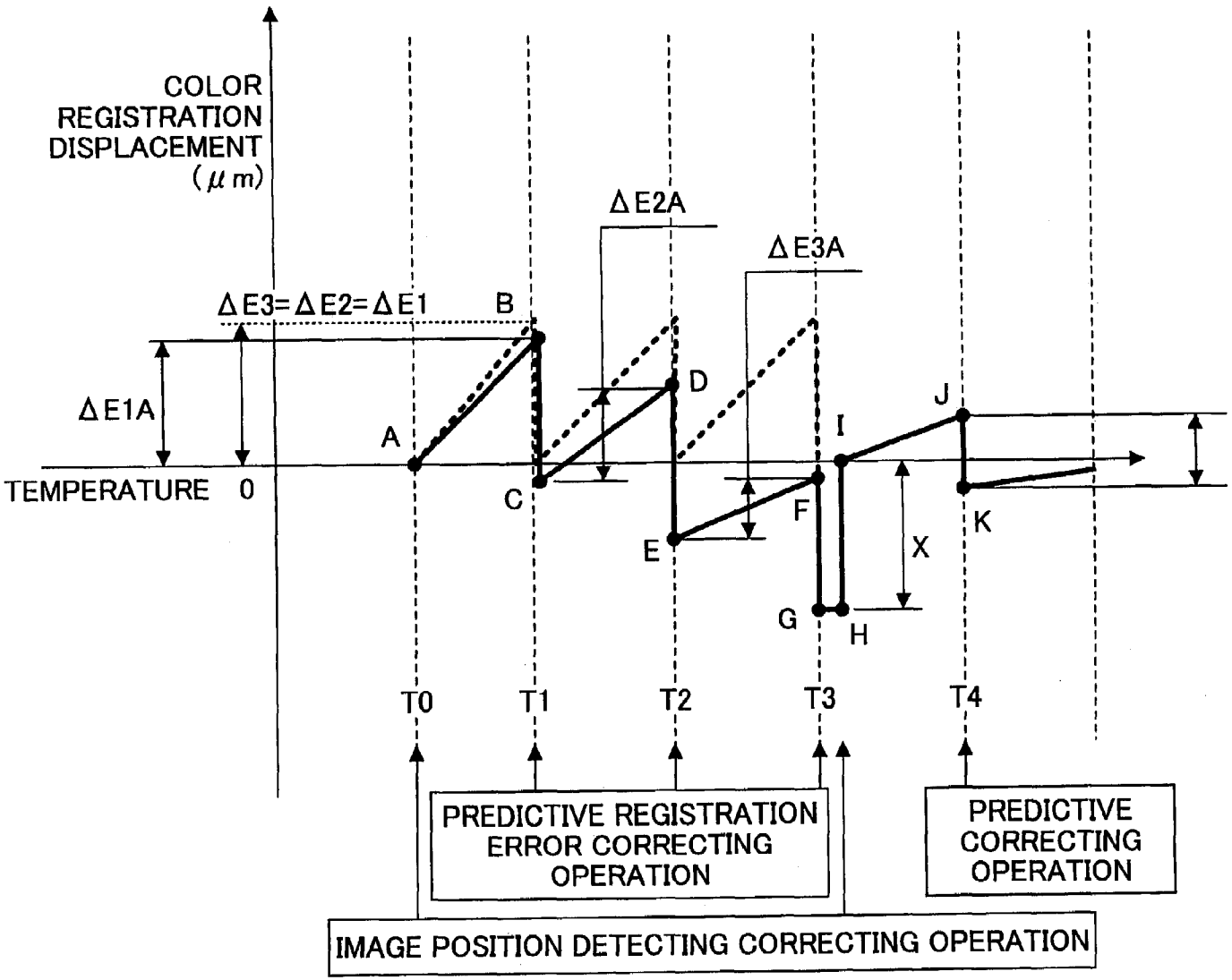
FIG. 10 is a time chart showing a fluctuation in a color registration error when a predictive registration error correction operation is repeated.

The FIG. 10 is a time chart for explaining the accumulation of the color registration error amount in the above-mentioned case. First, the color registration error amount is zero at the temperature T0. When the temperature gradually rises from a point A of the temperature T0 and reaches T1, the color registration error amount at that time is a value of a point B. Here, if a predictive position registration error correcting operation is performed at this time, the color registration error amount after the correcting operation does not return to zero and set to a value of a point C since the actual color registration error amount is less than the predicted color registration error amount by (ΔE1−ΔE1A). That is, the color registration error amount after the correcting operation becomes a value smaller than zero by a certain offset value Y1. The offset value OFFSET1 is represented by the following equation (1).

$$\text{OFFSET1}=\Delta E1-\Delta E1A=Y1 \quad (1)$$

When the temperature inside the image forming device further rises and reaches to T2, the actual color registration error amount is increased by deltaE2A from a value of the point C to a point D. At this time, if the predictive position registration error correcting operation is performed so as to perform a control to reduce the color registration error amount by ΔE2(=ΔE1=ΔE3), the color registration error amount does not return to zero and is set to a value of a point E. The offset value OFFSET2 at the point E is represented by the following equation (2).

$$\text{OFFSET2}=(\Delta E2-\Delta E2A)+Y1=Y2+Y1 \quad (2)$$

When the temperature inside the device rises from T2 to T3, the actual value of the color registration error amount becomes a value of a point F, and after the predictive position registration error correcting operation is performed, the color registration error amount becomes a value of a point G. The offset value OFFSET3 at the point G is represented by the following equation (3).

$$\text{OFFSET3}=(E3-\Delta E3A)+Y2+Y1=Y3+Y2+Y1 \quad (3)$$

(Case 1)

Next, the image registration error detection correcting operation is performed immediately after performing the predictive registration error correcting operation at the temperature T3. That is, a patch pattern is formed on the recording medium and a registration error is detected by the detector so as to perform a correcting operation so that the image registration error is eliminated. The image registration error detection correcting operation may be performed when a number of the predictive registration error correcting operations reaches a predetermined time, or may be performed when the temperature inside the image forming device reaches a predetermined value.

After the image registration error detection correcting operation is performed, the color registration error amount becomes a value of a point I, which is a zero position. If the registration error amount corrected at this time is set to X, the value of X is nearly equal to the above-mentioned (Y1+Y2+Y3). Accordingly, the above-mentioned offset amount Y on the average of one time is represented by the following equation (4).

$$Y=(Y1+Y2+Y3)/3=X/3 \quad (4)$$

Thus, by storing the correction value X in a memory each time the image registration error detection correcting operation is performed, the average offset value Y used when performing the predictive registration error correcting operation can be calculated. Then, by setting the correction values of the predictive registration error correcting operation at the temperatures T1, T2 and T3 to (ΔE1−Y), (ΔE2−Y and (ΔE3−Y), respectively, it becomes possible to perform the predictive correcting operation considering registration errors due to individual variation and a change with time passage.

(Case 2)

On the other hand, if the offset amount Y calculated by the equation (4) is smaller than a controllable correction pitch P, an integer value of P/Y is obtained so as to perform a correction of offset values of K and Y for each integer value. For example, if K=2, the offset values at the temperatures T1, T3 and T5 are set to 0 and the offset values at the temperatures T2, T4 and T6 are set to 2Y. Then, a control is performed so as to set the correction values in the predictive registration error correcting operation at the temperatures of T1, T2, T3, T4 . . . to ΔE1, (ΔE2−2Y), ΔE3, (ΔE4−2Y) . . .

FIG. 6 shows an example of a correction table stored in the memory of the control device for performing the above-mentioned predictive registration error correction control. The correction table consists of a part for storing registration error correction values predicted according to absolute temperatures, and a part for storing offset values calculated from the correction value X when performing the actual image registration error detection correcting operation. The initial offset values are indicated in the column of STEP1 in which a difference between the initial predicted value is 0. Then, when the temperature rises as T1, T2, T3 . . . , the offset values indicated in the columns of STEP2 in the above-mentioned case 1, or STEP3 in the above-mentioned case 2 are used in accordance with conditions. The column of STEP2 indicates offset values which causes the correction using the offset value of Y. The column of STEP3 indicates offset values which causes the correction using the offset value of KY for each K (=integer value of P/Y). In the example of FIG. 9, precious offset values are used at the absolute temperatures T-3, T-2, T-1. As indicated in the example at this time, the precious temperatures T-1, T-2, T-3 . . . including the temperature T0 at start are maintained at the temperatures before change.

Figure 12:
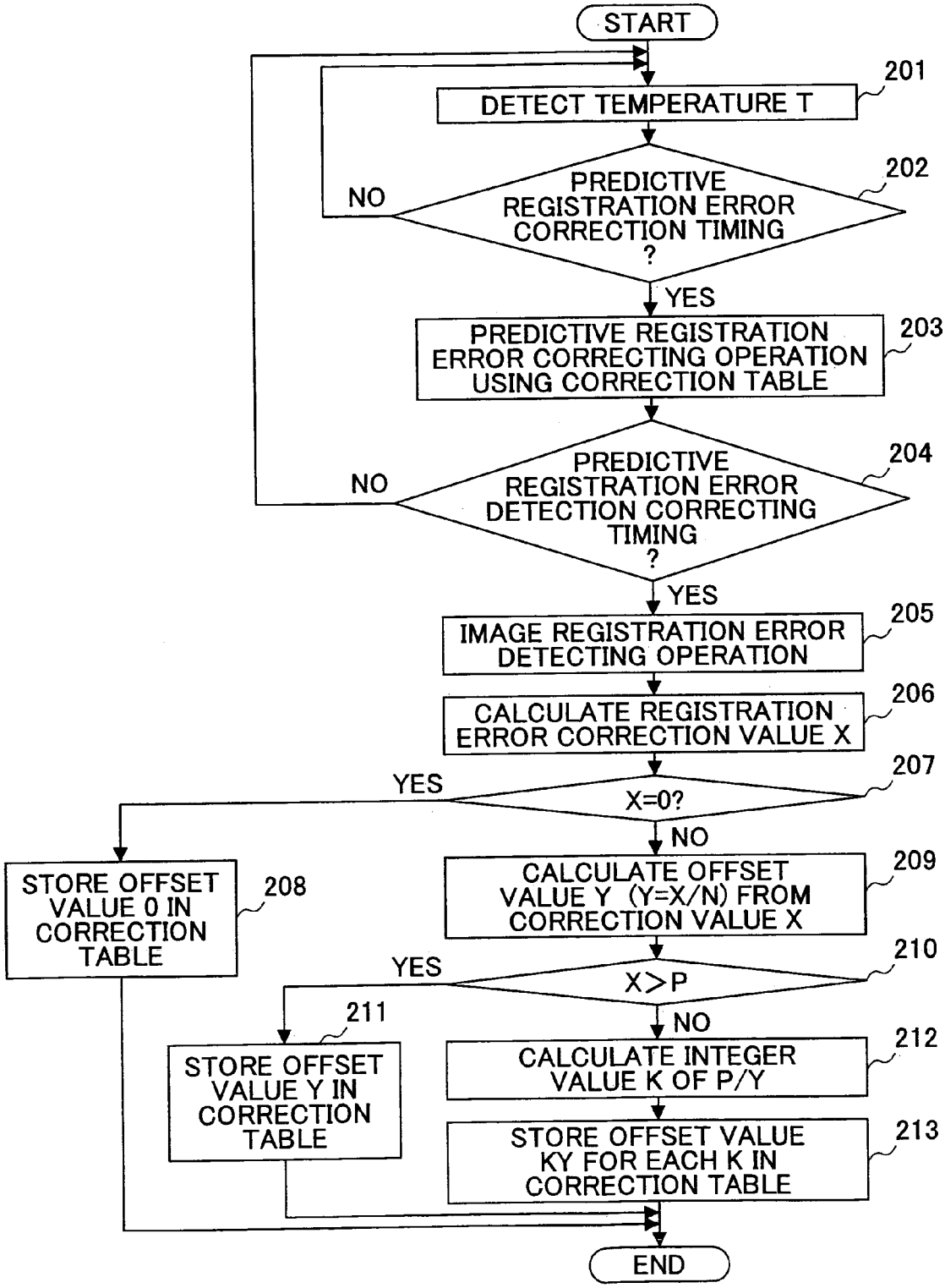
FIG. 12 is a flowchart of a control process of a color image forming device according to a first embodiment of the present invention.

A description will now be given, with reference to FIG. 12, of a control process performed by the image forming device according to the first embodiment of the present invention. A program causing a computer to perform the control process shown in FIG. 12 and the correction table shown in FIG. 9 are stored in the memory of the correction control part 107.

Figure 1:
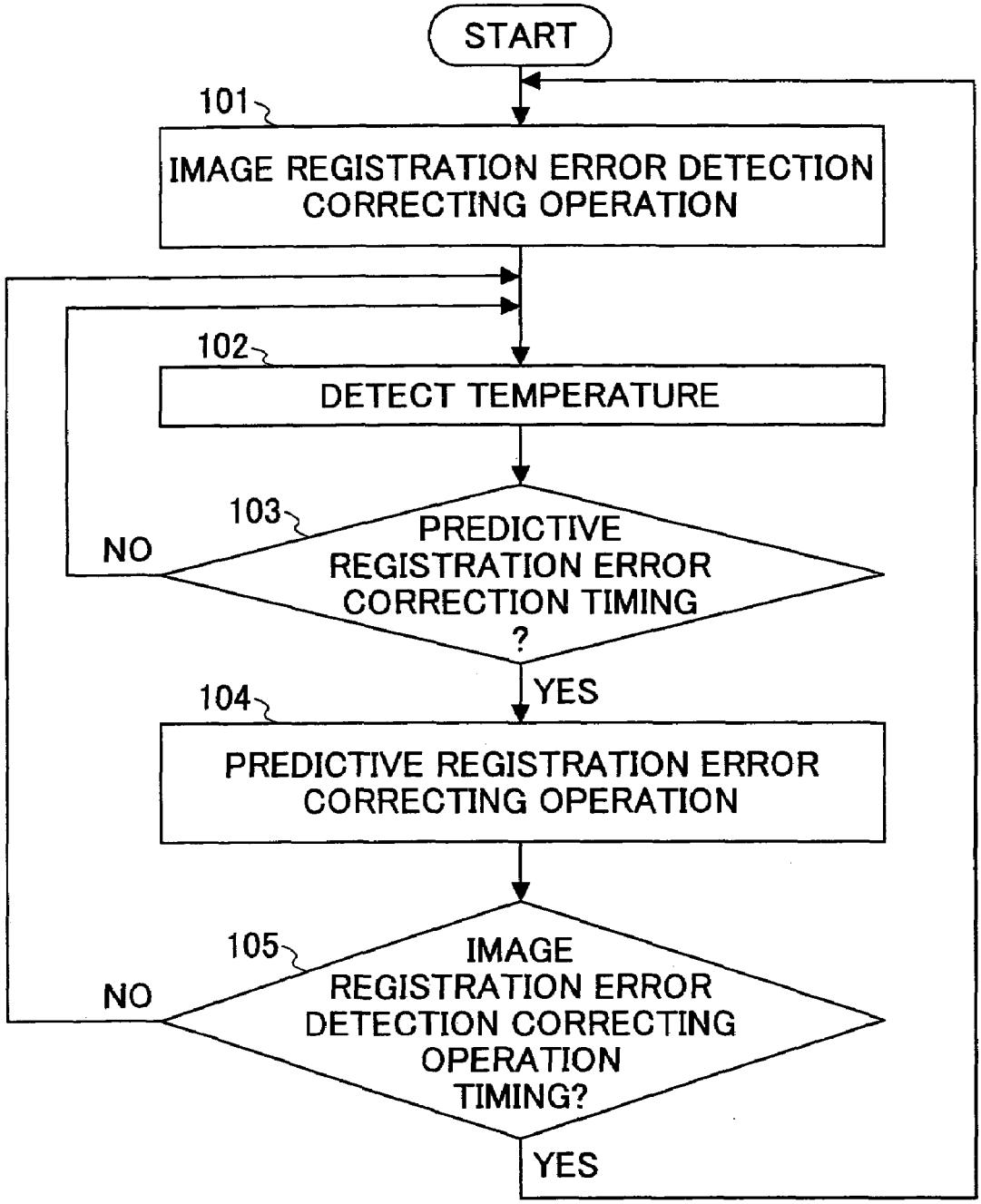
FIG. 1 is a flowchart of a control process of a conventional image forming device.
Figure 3:
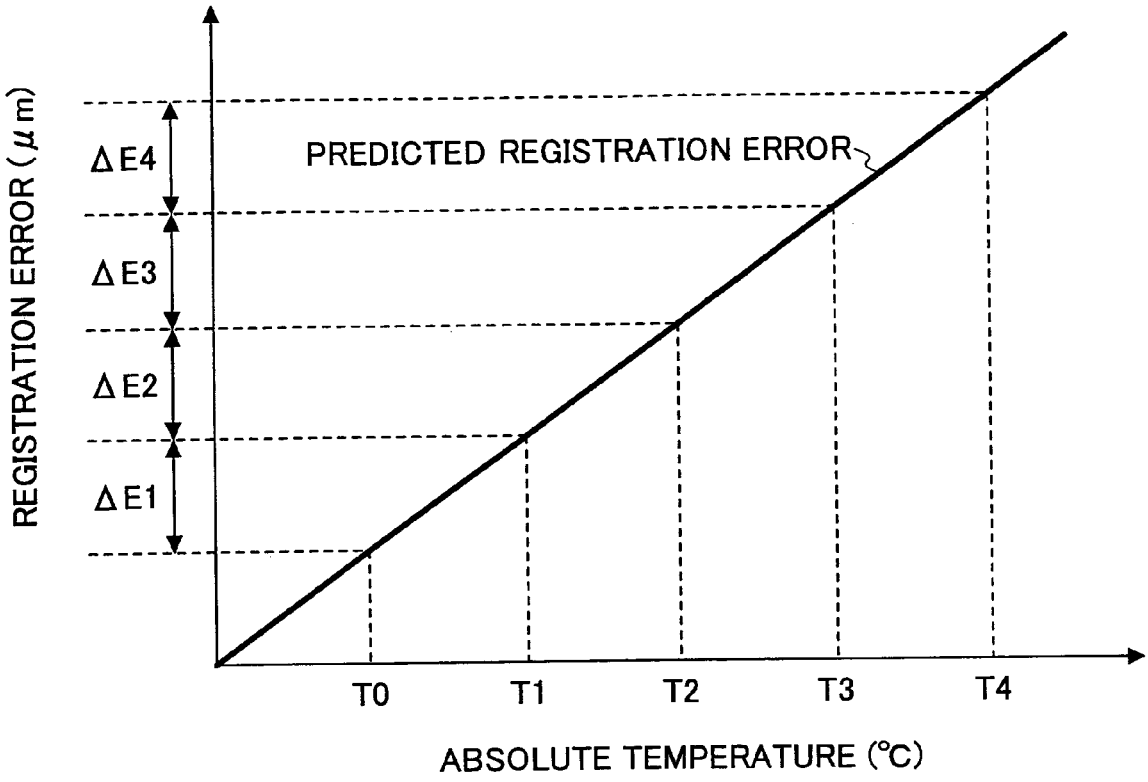
FIG. 3 is a graph showing a relationship between a registration error and an absolute temperature.

First, in step 201, the temperature T0 inside the image forming device is detected, and is stored in the memory of the correction control part 107 as a reference value. The temperature inside the device is represented by an average value of the detection signals of the temperature detectors 410K and 410Y shown in FIG. 1.

In step 202, it is determined whether or not the temperature inside the device rises from the reference value T0 to T1. That is, in the present embodiment, a time point at which the temperature inside the device reaches T1, T2, T3 . . . is set to the predictive registration error correction timing. If the predictive registration error correction timing is reached, the routine proceeds to step 203 so as to perform a correcting operation. The correcting operation is an operation to correct a registration error amount of (ΔE1−OFFSET) using the correction table of FIG. 9. Initially, all the offset values are set to 0.

Then, in step 204, it is determined whether or not it is the image registration error detection correcting operation timing. In the present embodiment, if the predictive registration error correcting operation is performed N times, it is determined that it is a time to perform the image registration error detection correcting operation. If the determination of step 204 is affirmative (YES), the routine proceeds to step 205 so as to perform the image registration error detection correcting operation. Further, in step 206, a registration error amount X actually corrected by the above-mentioned correcting operation is calculated. If X=0, or if X is smaller than a predetermined minimum value, the offset values corresponding to T1 to TN are set to 0.

On the other hand, if the registration error amount X is not 0, the value of Y=X/N is calculated in step 209. If it is determined, in step 210, whether or not the value of Y is greater than a controllable minimum correction pitch P. If the determination is affirmative (YES), the offset values corresponding to T1 through TN in the correction table are set to Y.

On the other hand, is the determination of step 210 is negative (NO), the routine proceeds to step 212 so as to calculate an integer value K of P/Y. Then, the offset values corresponding to T1 through TN in the correction table are set for every K.

Thus, after the offset values of the correction table are rewritten, the same operation is repeated again. Consequently, it becomes possible to minimize the registration error amount due to predictive registration error correcting operation, which enables improvement of an accuracy of registration between color images.

A description will now be given of an image forming device according to a second embodiment of the present invention.

In the Y-unit 100Y, the M-unit 100M, the C-unit 100C, and K-unit 100K that are vertically arranged as shown in FIG. 4, an upper unit receives a temperature of a lower unit, which generates a large change in temperature distribution. Thus, in the present embodiment, a temperature detector (temperature detecting means) is provided for each unit, or the temperature detector 410K and 410Y are provided to the lowermost unit and the uppermost unit, respectively, so as to obtain a temperature of each unit by predicting a temperature of an intermediate unit between the lowermost unit and the uppermost unit.

As mentioned above, if the reference color is K (black) and if a temperature difference is generated in each color unit with respect to the K-unit 100K, a change in the registration error amount differs from unit to unit. For example, the temperatures of the units are almost the same immediately after the device is started. However, the temperatures of the units rise, the temperature of an upper unit tends to be higher than the temperature of a lower unit since the upper unit receives influences of the temperature of the lower unit. As a result, a temperature difference is generated between the color units with passage of time. Thus, in the present embodiment, the predictive registration error correction value of each color with respect to the reference color is carried in accordance with the temperature difference with respect to the temperature difference. It should be noted that the reference color is not limited to K (black), and any one of C (cyan), M (magenta) and Y (Yellow) may be use without problem.

FIG. 8 shows an example of the correction table used in the present embodiment. In the correction table, the predictive registration error correction value varies in response to the temperature difference with respect to the reference color. That is, in this example, when the absolute temperature of the reference color is T0, T1, T2 . . . T8 and when the temperature difference to the reference color is 0° C., the predictive registration error correcting operation is performed using the correction values (ΔE0)0, (ΔE1)0, (ΔE2)0 . . . (ΔE8)0. When the temperature difference to the reference color is 1° C., the predictive registration error correcting operation is performed using the correction values (ΔE0)1, (ΔE1)1, (ΔE2)1 . . . (ΔE8)1. When the temperature difference to the reference color is 2° C., the predictive registration error correcting operation is performed using the correction values (ΔE0)2, (ΔE1)2, (ΔE2)2 . . . (ΔE8)2. The offset values used in this case are the same as that in the case of FIG. 9. As an example, in a case where the temperature of the K-unit 100K is T2, the temperatures of the M-unit 100M and the C-unit 100C are higher than T2 by 1° C., and the temperature of the Y-unit is higher than T2 by 2° C., the predictive registration error correction value of the K-unit 100K is (ΔE1)0-Y, the predictive registration error correction values of the M-unit 100M and the C-unit 100C are (ΔE1)1-Y, and the predictive registration error correction value of the Y-unit 100Y is (ΔE1)2-Y.

Figure 13:
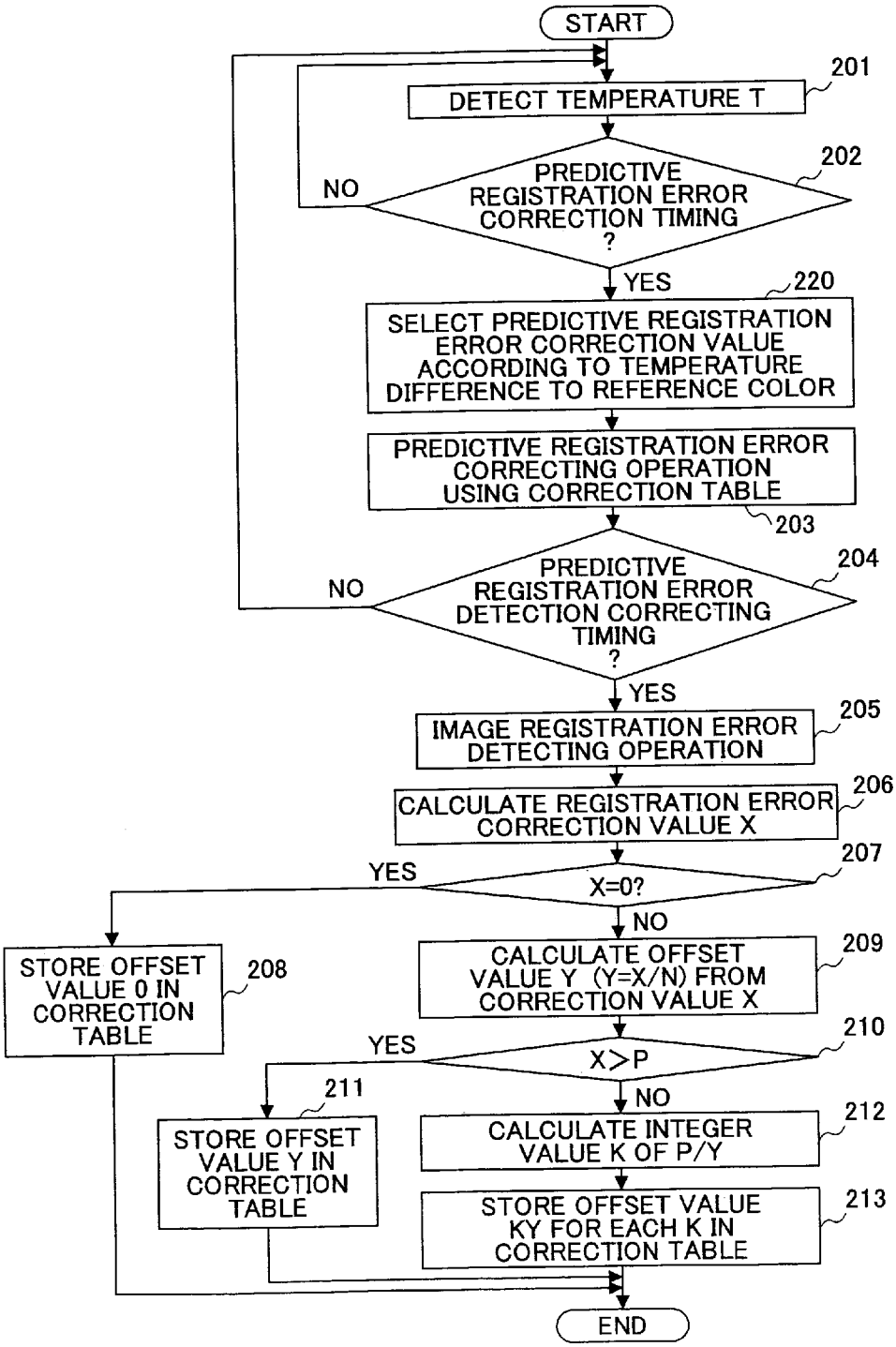
FIG. 13 is a flowchart of a control process of a color image forming device according to a second embodiment of the present invention.

FIG. 13 shows a control process performed by the image forming device according to the second embodiment of the present invention. In FIG. 13, steps the same as the steps shown in FIG. 12 are given the same reference numerals, and descriptions thereof will be omitted. In FIG. 13, a step 220 is added after the step 202. That is, if it is determined that it is the time to perform the predictive registration error correcting operation, a temperature difference between a temperature of the reference color unit and a temperature of each of the color units is obtained so as to select the predictive registration error correction value from the correction table of FIG. 11 in accordance with the obtained temperature difference. Then, in step 203, the predictive registration error correcting operation is performed using the registration error value different for each color unit.

According to the second embodiment of the present invention, since the prediction registration error correction value can be appropriately selected according to the temperature change for each unit, the color image forming device with less registration error can be provided.

The present invention is not limited to the specifically disclosed embodiments, and variations and modifications may be made without departing from the scope of the present invention.

The present application is based on Japanese priority application No. 2004-227476 filed Aug. 4, 2005, the entire contents of which are hereby incorporated herein by reference.

What is claimed is:

1. A color image forming device comprising:

a plurality of image forming units that form a color image on a recording material;

an image position detector that detects a position of each patch pattern of a toner image formed on the recording material and outputs a position detection signal corresponding to the detected position;

a temperature detector that detects a temperature inside said color image forming device and outputs a temperature detection signal corresponding to the detected temperature; and a registration error correction control part that performs a first correcting operation and a second correcting operation, the first correcting operation for correcting a registration error of image in accordance with the position detection signal of said image position detector, the second correcting operation for correcting a registration error predicted by referring to a correction table previously prepared in accordance with the temperature detection signal of said temperature detector, wherein said correction table includes a correction value previously determined in response to the temperature inside said color image fonning device and an offset value, which is changed each time said first correcting operation is performed; and said second correcting operation corrects the registration error by a value corresponding to said correction value plus or minus said offset value, and wherein said temperature detector includes a plurality of detectors that detects temperatures inside said color image forming device so as to detect a temperature difference between a temperature of an image forming unit of a reference color and a temperature of an image forming unit of a color other than the reference color.

2. The color image forming device as claimed in claim 1, wherein said registration error correction control part performs said second correcting operation N times between one execution of said first correcting operation and a subsequent execution of said first correcting operation.

3. The color image forming device as claimed in claim 2, wherein said correction table includes a column indicative of a first offset value and a column indicative of a second offset value so as to set the first offset value when X/N is greater than a minimum correction pitch P and set the second offset value when X/N is smaller than the minimum correction pitch, where X is a registration error correction amount in said first correcting operation.

4. The color image forming device as claimed in claim 3, wherein Y is set as the first offset value when Y>P, where Y is an absolute value of X/N.

5. The color image forming device as claimed in claim 3, wherein, when Y<P, KY is set as the second offset value for each K times in N times of said second correcting operations, where Y is an absolute value of X/N and K is an integer value of P/Y.

6. The color image forming device as claimed in claim 1, wherein said temperature detector includes a plurality of detectors that detects temperatures inside said color image forming device so as to determine the temperature inside said color image forming device as an average value of detection signals of the detectors.

7. The color image forming device as claimed in claim 1, said correction table contains a first correction value corresponding to a temperature of the image forming unit of the reference color and a second correction value previously determined in accordance with the temperature difference.

8. The color image forming device as claimed in claim 7, wherein, when performing said second correcting operation, said first correction value is used for the image forming unit of the reference color and said second correction value is used for the image forming unit of the color other than the reference color.

9. The color image forming device as claimed in claim 1, wherein when performing said second correcting operation, the image forming unit of the reference color and the image forming unit of the color other than the reference color use different correction values.

10. A color image forming device comprising:

a plurality of image forming units that form a color image on a recording material;

an image position detection device that detects a position of each patch pattern of a toner image formed on said recording material;

a correction control device that corrects a registration error in the color image in accordance with a registration error of said patch pattern; and a temperature detector that detects a temperature of at least one of the image forming units, wherein said correction control device has a correction table having a relationship between the temperature detected by said temperature detector and a registration error correction value corresponding to the temperature and detects a registration error of said patch pattern so as to perform image registration error correction and performs a predictive registration error correction using said correction table, wherein the registration error correction is performed in accordance with the image position detection after execution of said prediction registration error correction N (N>1) times so as to correct the registration error correction value or an offset value thereof in said correction table in accordance with the registration error correction value by said image position detection, and wherein said temperature detector includes a plurality of detectors that detects temperatures inside said color image forming device so as to detect a temperature difference between a temperature of an image forming unit of a reference color and a temperature of an image forming unit of a color other than the reference color.

11. A color image forming device comprising:

a plurality of image forming units arranged in a vertical direction along a recording material so as to form a color image on the recording material;

an image position detection device that detects a position of each color patch pattern of a toner image formed on said recording material;

a correction control device that corrects a registration error in the color image in accordance with a registration error of said patch pattern; and a temperature detector that detects a temperature of at least two of the image forming units, wherein said correction control device has a correction table having a relationship between the temperature detected by said temperature detector and a registration error correction value corresponding to the temperature so as to perform a predictive registration error correction using the correction table, and wherein a temperature difference between the image forming unit of a reference color and the image forming unit of a color other than the reference color is detected or calculated by said temperature detector so as to perform the predictive registration error correction in accordance with the registration error correction value different for each image forming unit.

* * * * *